United States Patent [19]

Kittscher et al.

[11] Patent Number: 4,700,857

[45] Date of Patent: Oct. 20, 1987

[54] CONTAINER WITH FUSED CLOSURE

[75] Inventors: Peter Kittscher, Buettgen; Herbert Buecheler, Erkrath, both of Fed. Rep. of Germany

[73] Assignee: Henkel Kommanditgesellschaft auf Aktien, Duesseldorf, Fed. Rep. of Germany

[21] Appl. No.: 893,859

[22] Filed: Aug. 6, 1986

[30] Foreign Application Priority Data

Sep. 9, 1985 [DE] Fed. Rep. of Germany ..... 3532041
Jan. 16, 1986 [DE] Fed. Rep. of Germany ..... 3601016

[51] Int. Cl.[4] ..... B65D 41/00
[52] U.S. Cl. ..... 215/232; 215/233
[58] Field of Search ..... 215/232, 233; 220/201, 220/359

[56] References Cited

U.S. PATENT DOCUMENTS 774,119 11/1904 Vaughan ..... 215/233
4,109,815 8/1978 Collins ..... 215/232
4,553,679 11/1985 Hatakeyama et al. ..... 215/232

*Primary Examiner*—Donald F. Norton
*Attorney, Agent, or Firm*—Ernest G. Szoke; Henry E. Millson, Jr.; Real J. Grandmaison

[57] ABSTRACT

A container or the like for cleaning preparations comprising a fused closure which consists of a stopper disposed in a closure hole of the container and made of a material which melts at a predetermined temperature and which releases the closure hole for the exit of product packaged in the container. A ring of which the thickness increases radially inwards towards the axis of the hole is integrally formed with the inner peripheral surface of the closure hole. The position and shape of the stopper are stabilized by a film applied by sealing to the outside of the closure hole. The walls of the container are flexible to accomodate changes in pressure inside the container.

22 Claims, 2 Drawing Figures

CONTAINER WITH FUSED CLOSURE

BACKGROUND OF THE INVENTON

1. Field of the Invention

This invention relates to a container or the like for cleaning preparations comprising a fused closure which consists of a stopper disposed in a closure hole of the container, more especially in the cover thereof. The stopper comprises a material which melts at a predetermined temperature, e.g., paraffin, and which releases the closure hole for the exit of a product packaged in the container. A ring is raised towards the axis of the closure hole integrally formed with the peripheral surface of the closure hole and with a sealing film holding the unmelted stopper in place.

2. Description of Related Art

Liquid-tight fused closures are used in product containers which are to be opened at a certain temperature in a closed space in the course of a given process. For example, containers having a fused closure are used for packaging machine care preparations intended for use in dishwashing machines. In such a case, the unopened container is introduced into the machine compartment. The machine is then switched on after closure of the machine compartment. In order to prevent the machine-care product from issuing prematurely from the container, the constituent material of the fused closure is selected in such a way that the stopper only melts at the temperature most favorable to the use of the product, i.e., the product only enters the machine compartment at that time. In addition, the stopper should not be able to slide out of its position in the closure hole of the container without melting. Accordingly, a collar raised towards the axis of the closure hole has been integrally formed around the peripheral surface of the closure hole in order to hold the stopper in place.

During the stoppage of closed product containers of the type herein, undesirable leaking of the product can occur between the peripheral surface of the closure hole and the stopper as a result of variations in temperature. This effect occurs in particular where the product is one which has a tendency to leak combined with a strong wetting action. One reason for the leakage of product is that minute gaps are formed through variations in temperature between the wall or peripheral surface of the closure hole and the fused stopper disposed, more especially cast, herein, through which the product is able to leak, optionally via the collar.

This problem may be eliminated by adapting the thermal expansion coefficients of the materials adjoining one another in the region of the stopper. However, since the choice of material for the container and the fused closure is determined by a number of other requirements, for example, temperature stability and melting point, mechanical stability, chemical stability and the like, it is only possible to strike a more or less acceptable compromise when adapting the temperature coefficients.

If a product container effectively sealed by the fused closure is obtained in accordance with the foregoing, an excess pressure can be expected to build up inside the container in the event of an increase in temperature of gas-evolving products below the melting temperature of the stopper. In some cases, the excess pressure even acts on the stopper. The constituent material of the stopper is generally relatively soft at elevated temperature because it is intended to melt in the event of a further increase in temperature. In the event of significant variations in temperatures, for example, as during day and night, it can happen that the stopper acts a pump through alternating excess pressure and reduced pressure and outwardly transports product adhering to the inner surface of the stopper.

The object of this invention, in general, is to provide a seal which prevents the premature emergence of the product stored in the container and which is effective even despite a difference in temperature expansion behavior between the container or cover wall on the one hand and the stopper disposed in the closure hole of the container on the other hand. In particular, the invention seeks to prevent the position of the stopper relative to the closure hole from being changed by temperature-induced changes in the pressure prevailing inside the container.

SUMMARY OF THE INVENTION

In a container or the like for cleaning preparations such as earlier mentioned comprising a stopper-like fused closure disposed in a closure hole and a raised ring intergrally formed with the peripheral surface of the closure hole projecting in the direction of its axis, the improvement provided by this invention is characterized in that the ring increases in thickness as it extends radially from the peripheral surface of the closure hole inwards towards the axis of the closure hole.

DETAILED DESCRIPTION OF THE INVENTION

In accordance with this invention, the increase in the thickness of the ring is preferably intended to be mirror-symmetrical in relation to the plane extending perpendicularly to the axis of the closure hole substantially through the center thereof. A ring of dovetail profile or T-shaped profile is particularly suitable.

According to another aspect of the invention, the following measures may be taken to stabilize the stopper against temperature-induced changes in pressure inside the container. First, the stopper itself may be stabilized by providing a raised ring around the closure hole on the outside of the container, particularly on its cover, for the sealing of a closure film to the raised ring. In addition, the sealing film covering the closure hole on the outside of the container is particularly stable if it is made of precision-stamped aluminum coated with polypropylene lacquer, more especially having a thickness of about 40 micrometers. The film may be provided with a freely projecting tab so that it may readily be withdrawn before use.

In addition to the measures for securing the stopper by means of the sealing film, it is also desirable to design the product container where it is in the form of a polyethylene bottle, preferably having a rectangular cross-section in such a way that an adequate compression load strength is achieved at a predetermined stacking height, and further in such a way that, at the same time, the container walls remain so flexible that the vapor pressure of the contents of the container may increase in the event of periodic increases in ambient temperature without the relatively soft stopper being affected either in its shape or in its position. Accordingly, the container wall thickness should preferably be between a minimum value corresponding to a predetermined stacking height, more especially at least about 0.7 mm on the one hand, and a maximum value which allows thermoplastic expansion and contraction in the event of temperature-induced changes in pressure, more especially of at least around 0.05 bar, inside the container.

The configuration according to the invention of the inner peripheral surface of the closure hole, i.e., of the ring profile completely surrounded by the stopper material to be melted, ensures that a fused closure contracting in relation to the constituent material of the container adjoins the ring even more closely during the shrinkage process than was originally the case during casting of the closure stopper into the closure hole. When the cross-section of the ring for the closure stopper increases from the peripheral surface of the closure hole towards the axis thereof as proposed in accordance with the invention, a completely fluid-tight closure is obtained even where the stopper has contracted relative to the constituent material of the wall of the closure hole and may only be opened by melting of the stopper, in the absence of excessive pressure. This advantage is enhanced by the fact that the distance which the product stored in the container has to travel past the stopper to leave the container is increased in labyrinth-fashion by the shape of the ring according to the invention.

An embodiment of the invention is described in detail in the following with reference to the accompanyng drawings.

DETAILED DESCRIPTION OF A PREFERRED EMBODIMENT

Figure 1:
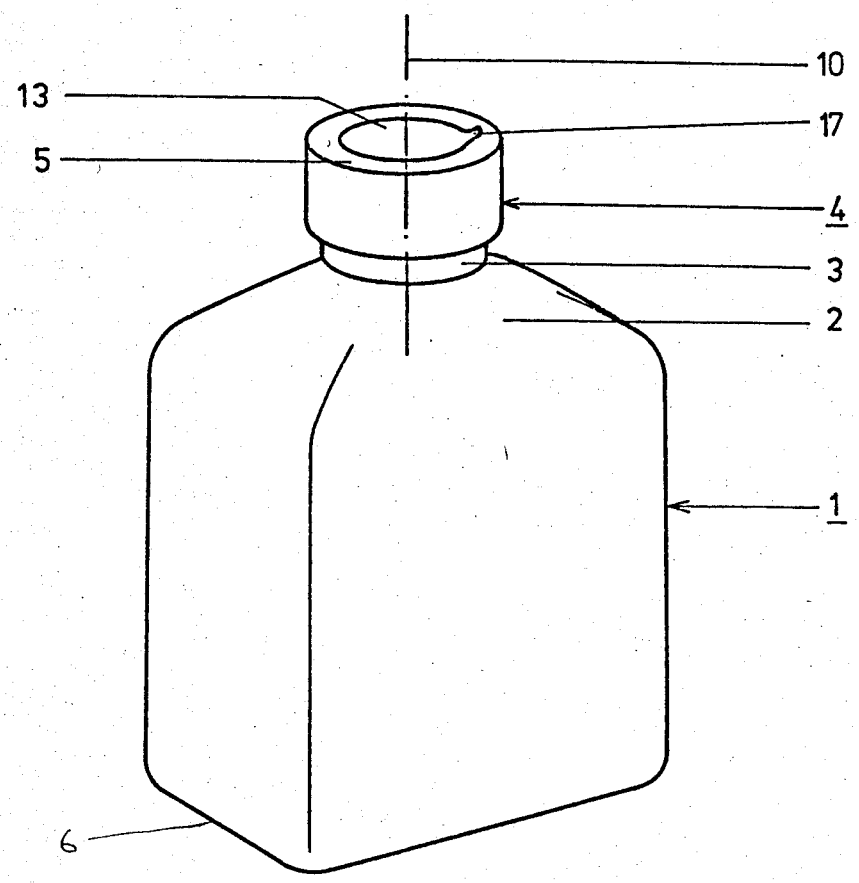
FIG. 1 is a perspective side view of a rectangular container together with its cover.

A polyethylene bottle 1 having a rectangular cross-section is diagrammatically illustrated in FIG. 1. On its shoulder or upper side 2, bottle 1 comprises a neck 3 with a cover 4. The rectangular cross-section of the bottle provides for a relatively high compression load strength on stacking. For safe stacking, the upper surface 5 of the cover 4 may be made with a large surface which is also flat or parallel to the base 6 of the bottle. When the bottle has relatively thin walls, the compression load strength of the bottle may be additionally increased by arching the upper side 2 of the bottle.

Figure 2:
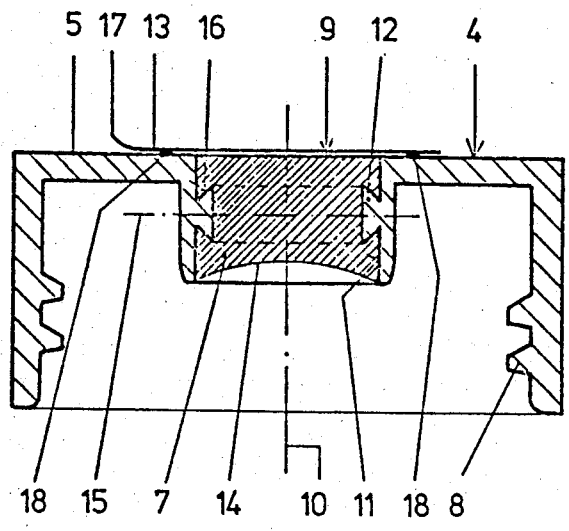
FIG. 2 is a cross-sectional side view of the container.

The rectangular polyethylene bottle 1 shown in FIG. 1 is preferably designed in such a way that a still adequate compression load strength is achieved for a predetermined stacking height of the bottle, while at the same time the walls remain so flexible that they are able to accommodate temperature-induced changes in pressure inside the bottle. In particular, the walls of the bottle 1 are intended to be able to expand and contract so easily that changes in pressure inside the bottle are unable to result in any damage to the stopper disposed in the neck 3 of the bottle as shown in FIG. 2.

Details of the cover 4 and of the fused closure disposed therein are described in the following with reference to FIG. 2 which is a cross-sectional side view through the cover 4 of the container for a cleaning preparation, for example, the bottle 1 shown in FIG. 1. In the embodiment illustrated, cover 4 is in the form of a screw cap with an internal screwthread 8 and an upper surface 5 in which closure hole 9 is formed. Closure hole 9 is preferably arranged symmetrically in relation to its axis 10 and is made so long in the direction of the axis 10 that a fused material, such as paraffin, introduced into closure hole 9, forms a closure stopper 7 which is also sufficiently safe for storage up to a predetermined temperature. Closure stopper 7 is prevented from being prematurely dislodged from closure hole 9 by a ring 12 formed integrally around the inner surface or around the inner peripehral surface 11 of closure hole 9 symmetrically in relation to its axis 10.

Closure stopper 7 may be made, for example, by casting a fusible material into closure hole 9. To this end, closure hole 9 in the upper surface 5 of the screw cap is closed with a sealing film 13 and the fusible material is cast into closure hole 9 with the cap 4 cover upside down, i.e., resting on its upper surface 5. In this way, a concave meniscus 14 can form in the solidified closure stopper 7 on the inside of the cap.

Ring 12 integrally formed with the inner peripherial surface 11 of closure hole 9 preferably comprises an increase in thickness mirror-symmetrical to the plane 15 extending perpendicularly to the axis 10 of closure hole 9 in the middle of the ring, for example, with a dovetail profile or a T-profile.

When closure hole 9 is provided with an integrally formed ring 12 of dovetail profile on its inner peripheral surface 11 and when the profile is fully enclosed by the stopper material cast in closure hole 9, an increasingly tighter closure is formed during the contraction of closure stopper 7 because the contracting material is applied more closely than originally during casting to the outer sides 16 of the dovetail profile which face towards the peripheral surface 11 and away from the axis 10 of the closure hole. In addition, in this configuration of the ring 12, the distance which the product stored in the container has to travel past the still solid stopper 7 to pass through closure hole 9 is increased in labyrinth-fashion.

Closure stopper 7 is additionally stabilized in closure hole 9 by sealing film 13. This sealing film may consist of aluminm approximately 40 micrometers in thickness coated with polypropylene lacquer, and may have a freely projecting tab 17 to make it easier to remove sealing film 13.

The stable application by heat sealing of film 13 to the upper surface 5 of closure cap 4 is simplified when a raised ring 18 is provided around closure hole 9 on the upper surface 5 of the cap for the purpose of sealing thereon film 13. The extent to which ring 18 is raised in relation to the preferably flat remainder of the upper surface 5 of the cap may be substantially equivalent to the thickness of sealing film 13. When sealing film 13 is thus anchored relatively firmly on the upper surface 5 of the cap, it is able to increase the stability of closure stopper 7 with respect to excess or reduced pressures acting from inside the container. Sealing film 13 may preferably be stiffened in this regard by precision stamping of the film material.

We claim:

1. A container for cleaning preparations, said container having a fused closure comprising a closure stopper disposed in a closure hole of said container, wherein said closure stopper is made of a material which melts at a predetermined temperature and releases the closure hole for the exit of a product packaged in said container, said closure hole having a raised ring integrally formed with the peripheral surface of said closure hole wherein said raised ring projects in the direction of the axis of said closure hole, and further wherein said ring increases in thickness as it extends radially from said peripheral surface of said closure hole inwards towards said axis of said closure hole.

2. A container in accordance with claim 1 wherein the increase in thickness of said ring is mirror-symmetrical in relation to the plane extending perpendicularly to said axis of said closure hole through the middle of said ring.

3. A container in accordance with claim 1 wherein said ring has a dovetail profile.

4. A container in accordance with claim 1 wherein said ring has a T-shaped profile.

5. A container in accordance with claim 1 in the form of a polyethylene bottle having a rectangular cross-section, said polyethylene bottle having a wall thickness sufficient to provide said bottle with an adequate compression load strength at a predetermined stacking height thereof, and which allows thermoplastic expansion and contraction of said bottle under temperature-induced changes in pressure inside said bottle.

6. A container in accordance with claim 5 wherein said wall thickness is at least about 0.7 mm.

7. A container in accordance with claim 1 wherein said fused closure is disposed in a cover for said container.

8. A container is accordance with claim 7 wherein a raised ring is provided around said closure hole and is located on the upper surface of said cover.

9. A container in accordance with claim 8 wherein a sealing film is secured to said raised ring located on upper surface of said cover.

10. A container in accordance with claim 9 wherein said sealing film is mad of aluminum coated with polypropylene lacquer.

11. A container in accordance with claim 9 wherein said sealing film is provided with a projecting removal tab.

12. A container for a cleaning preparation, said container comprising walls having a wall thickness sufficient to provide said container with an adequate compression load strength at a predetermined stacking height of said container, and which allows expansion and contraction of said container under temperature-induced changes in pressure inside said container; said container having an opening and a cover for said opening; said cover having an upper surface in which a closure hole is formed; a closure stopper disposed in said closure hole wherein said closure stopper comprises a fused closure made of a material which melts at a predetermined temperature and releases said closure hole for the exit of a product packaged in said container; said closure hole having a raised ring integrally formed with the peripheral surface of said closure hole wherein said raised ring projects in the direction of the axis of said closure hole, and further wherein said ring increases in thickness as it extends radially from said peripheral surface of said closure hole inwards towards said axis of said closure hole.

13. A container in accordance with claim 12 wherein the increase in the thickness of said ring is mirror-symmetrical in relation to the plane extending perpendicularly to said axis of said closure hole through the middle of said ring.

14. A container in accordance with claim 12 wherein said ring has a dovetail profile.

15. A container in accordance with claim 12 wherein said ring has a T-shaped profile.

16. A container in accordance with claim 12 wherein said raised ring around said closure hole is provided on the upper surface of said cover.

17. A container in accordance with claim 16 wherein a sealing film is secured to said raised ring located on said upper surface of said cover.

18. A container in accordance with claim 17 wherein said sealing film is made of aluminum coated with polypropylene lacquer.

19. A container in accordance with claim 17 wherein said sealing film is provided with a projecting removal tab.

20. A container in accordance with claim 12 in the form of a polyethylene bottle having a rectangular cross-section.

21. A container in accordance with claim 12 wherein said cover is in the form of a screw cap with an internal screwthread.

22. A container in accordance with claim 12 wherein said material which melts at a predetermined temperature comprises paraffin.

* * * * *